US012631390B1

(12) United States Patent
Tippmann et al.

(10) Patent No.: US 12,631,390 B1
(45) Date of Patent: May 19, 2026

(54) DEFROST SYSTEM FOR A CONDITIONED SPACE

(71) Applicant: Tippmann Engineering, LLC, Fort Wayne, IN (US)

(72) Inventors: Daniel J. Tippmann, Fort Wayne, IN (US); Robert T. Tippmann, III, Fort Wayne, IN (US)

(73) Assignee: Tippmann Engineering, LLC, Fort Wayne, IN (US)

( * ) Notice: Subject to any disclaimer, the term of this patent is extended or adjusted under 35 U.S.C. 154(b) by 70 days.

(21) Appl. No.: 18/505,423

(22) Filed: Nov. 9, 2023

(51) Int. Cl.
*F25D 21/08* (2006.01)
*F25D 21/00* (2006.01)

(52) U.S. Cl.
CPC ..... *F25D 21/08* (2013.01); *F25D 21/004* (2013.01)

(58) Field of Classification Search
CPC ..... B60H 1/321; F25D 21/006; F25D 21/08
See application file for complete search history.

(56) References Cited

U.S. PATENT DOCUMENTS 3,122,892 A 3/1964 Beckwith
3,774,406 A 11/1973 Reitblatt
3,894,404 A 7/1975 Stanton
4,392,358 A 7/1983 Hicks
4,528,821 A 7/1985 Tershak et al.
5,379,608 A 1/1995 Ishimaru et al.
5,761,922 A 6/1998 Tamai et al.
6,481,231 B2 * 11/2002 Vogel ..... F25B 47/025 62/278
7,032,395 B2 4/2006 Hanson et al.
9,784,490 B2 10/2017 Tippmann
9,933,199 B2 * 4/2018 Lukasse ..... F25D 21/02
10,696,139 B2 * 6/2020 Benedict ..... F25D 11/003
11,287,172 B2 3/2022 Tippmann
11,549,740 B2 * 1/2023 Kim ..... F25D 21/025
2006/0248904 A1 * 11/2006 Ludwig ..... B60H 1/00014 62/208
2017/0276422 A1 * 9/2017 Chamoun ..... F25D 21/04
2019/0234676 A1 * 8/2019 Walser ..... F25D 21/006
2021/0156600 A1 5/2021 Izadi-Zamanabadi et al.

FOREIGN PATENT DOCUMENTS

CN 211876502 U * 11/2020

* cited by examiner

*Primary Examiner* — Lionel Nouketcha
(74) *Attorney, Agent, or Firm* — Brian S. Bailey

(57) ABSTRACT

A defrost system for a vapor-compression based refrigerator/freezer combines increased operational efficiency with a high likelihood of robust adoption by technical and business personnel. The system includes a controller programmed to monitors and reports several key performance indicators on each evaporator of the system, and to provide reliable, repeatable "initiate defrost" and "terminate defrost" signals which may prompt actions by an operator or automatically control system components. The controller is designed to provide accurate and efficient defrosting signals regardless of the style of evaporator used, the location of the evaporator and other conditions including pull-down, high traffic locations and operations, and low use periods such as weekends.

19 Claims, 11 Drawing Sheets

DEFROST SYSTEM FOR A CONDITIONED SPACE

BACKGROUND

1. Technical Field

The present disclosure relates to freezers and, in particular, to defrost and defrost control systems for industrial-scale freezers.

2. Description of the Related Art

Industrial freezer systems are configured for the particular site where the system is installed. An installing contractor and/or a refrigeration technician are generally tasked with determining and setting defrost sequencing for such freezer systems, as well as the scheduling of defrosts for all evaporators. These skilled individuals will almost certainly err on the side of over-defrosting, rather than risking frozen evaporators, especially during commissioning. Frozen evaporators lead to either warranty calls for the installing contractor or headaches for the refrigeration technician.

Therefore, generous sequencing of defrost steps combined with extra-conservative defrost schedules lead directly to over-defrosting. Over-defrosting reduces available evaporator run-time and adds significant heat and moisture back into the freezer. Technicians may not intend to needlessly cause these problems but they also very much do not want to deal with frozen evaporators, which entails the difficult work of clearing a frozen coil and chipping ice off of freezer floors.

Moreover, technicians involved in commissioning control systems used for defrost management generally lack the tools necessary to determine the effects and quantify the costs associated with defrost settings. Therefore, commissioning technicians will not generally even attempt to weigh the effects of over-generous defrost cycle settings versus lost refrigeration run time, heat added to freezer space and the associated utility costs.

Defrost schedules are generally set-up during commissioning and pull-down (i.e., initial cooling) of freezer spaces. During pull-down of a freezer, huge amounts of moisture are being removed from the space, thus requiring unusually frequent defrost periods. Often these pull-down defrost settings will not be changed because everything is working. The Refrigeration Technician has seen the initial settings work in these very challenging conditions, and they are not motivated to change them away from these proven values. The result is that many evaporators serving commercial freezer systems are being over-defrosted.

During an operational day, evaporators located near frequently opened freeze/dock doors receive vastly more moisture (latent) load compared to evaporators located further from doorways. However, the settings determined to be effective to keep the evaporators nearest the doors clean are typically used for every evaporator in the freezer space. These settings are not changed because the refrigeration technician has seen these settings work in these very challenging conditions, and they are not motivated to change them away from these proven values. Again, in such situations most or all of the evaporators serving the freezer system are being over-defrosted.

SUMMARY

The present disclosure provides a defrost system for a vapor-compression based refrigerator/freezer which combines increased operational efficiency with a high likelihood of robust adoption by technical and business personnel. The system includes a controller programmed to monitors and reports several key performance indicators on each evaporator of the system, and to provide reliable, repeatable "initiate defrost" and "terminate defrost" signals which may prompt actions by an operator or automatically control system components. The controller is designed to provide accurate and efficient defrosting signals regardless of the style of evaporator used, the location of the evaporator and other conditions including pull-down, high traffic locations and operations, and low use periods such as weekends.

In one form thereof, the present disclosure provides a defrost system including a vapor compression system including a compressor, a condenser, an expansion valve, an evaporator having coils and an airflow pathway therethrough, and a quantity of refrigerant. The system also includes a defrost heater operably connected to the evaporator and configured to melt accumulated ice or frost from the coils of the evaporator upon activation. A fan is positioned and oriented to blow over the coils of the evaporator. A controller is included with an upstream pressure sensor operably connected to the controller and positioned downstream of the fan and upstream of the airflow pathway through the evaporator, and a downstream pressure sensor operably connected to the controller and positioned downstream of the airflow pathway through the evaporator. The controller is programmed to process signals received from the upstream pressure sensor and the downstream pressure sensor to determine whether a defrost cycle is needed, and upon determination that the defrost cycle is needed, initiate the defrost cycle via control over at least one component of the vapor compression system.

In another form thereof, the present disclosure provides a method of defrosting evaporator coils, the method including activating a fan to direct an airflow over the evaporator coils, measuring an upstream air pressure at a location downstream of the fan and upstream of the evaporator coils, measuring a downstream air pressure at a location downstream of the fan and downstream of the evaporator coils, and calculating an air pressure differential between the downstream and the upstream air pressure. When the calculated air pressure differential reaches a threshold indicative of frost buildup on the coils, the method further includes heating the coils to melt the frost buildup.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

Corresponding reference characters indicate corresponding parts throughout the several views.

DETAILED DESCRIPTION

The embodiments disclosed below are not intended to be exhaustive or to limit the invention to the precise forms disclosed in the following detailed description. Rather, the embodiments are chosen and described so that others skilled in the art may utilize their teachings.

As described in detail below, the present disclosure provides a defrost system, such as system 100 shown in FIG. 2, with excellent and reliable "Demand-Defrost" sensing and other useful features which is able to be installed and commissioned with efficient operation but without causing evaporator or freezer frost. In this way, refrigeration technicians using system 100 can be counted upon to adopt and support system 100 on-site. Additionally, the present defrost system provides business personnel, such as owner/executive of a freezer system employing system 100, with an attractive payback while also exceeding the needs and expectations of the refrigeration technician. In particular, and as further discussed in detail below, system 100 accurately matches the need for defrost for each individual evaporator with the defrost cycle. This, in turn, keeps all evaporators operating at peak efficiency, reduces the frequency of defrost cycles and prevents over-defrosting and its associated inefficiencies.

1. System Configuration

The present defrost system, such as system 100, is configured to continually monitor and report key performance values to a controller 102. Controller 102 may then process the performance values to generate an electronic dashboard 200 (FIGS. 5-7), which can help identify and report potential maintenance/performance issues. In addition to this "advisor" function, controller 102 may also provide a "commander" function in which it issues "Demand Defrost" signals to initiate defrost cycles at appropriate times, and "Termination" signals to terminate the defrost cycles at appropriate times. Other system components may also be automatically controlled as discussed herein.

System 100 includes a vapor compression system 110 operable to remove heat from a freezer space and discharge the heat to an ambient space outside the freezer. The general function of vapor compression systems is well-known to people of ordinary skill in the art, and a particular vapor compression system useable in connection with system 100 is described in U.S. Pat. No. 9,784,490, issued Oct. 10, 2017 and entitled "Refrigeration system with humidity control," and U.S. Pat. No. 11,287,172, issued Mar. 29, 2022 and entitled FREEZER DEHUMIDIFICATION SYSTEM, the entire disclosures of which are hereby incorporated herein by reference.

Figure 1:
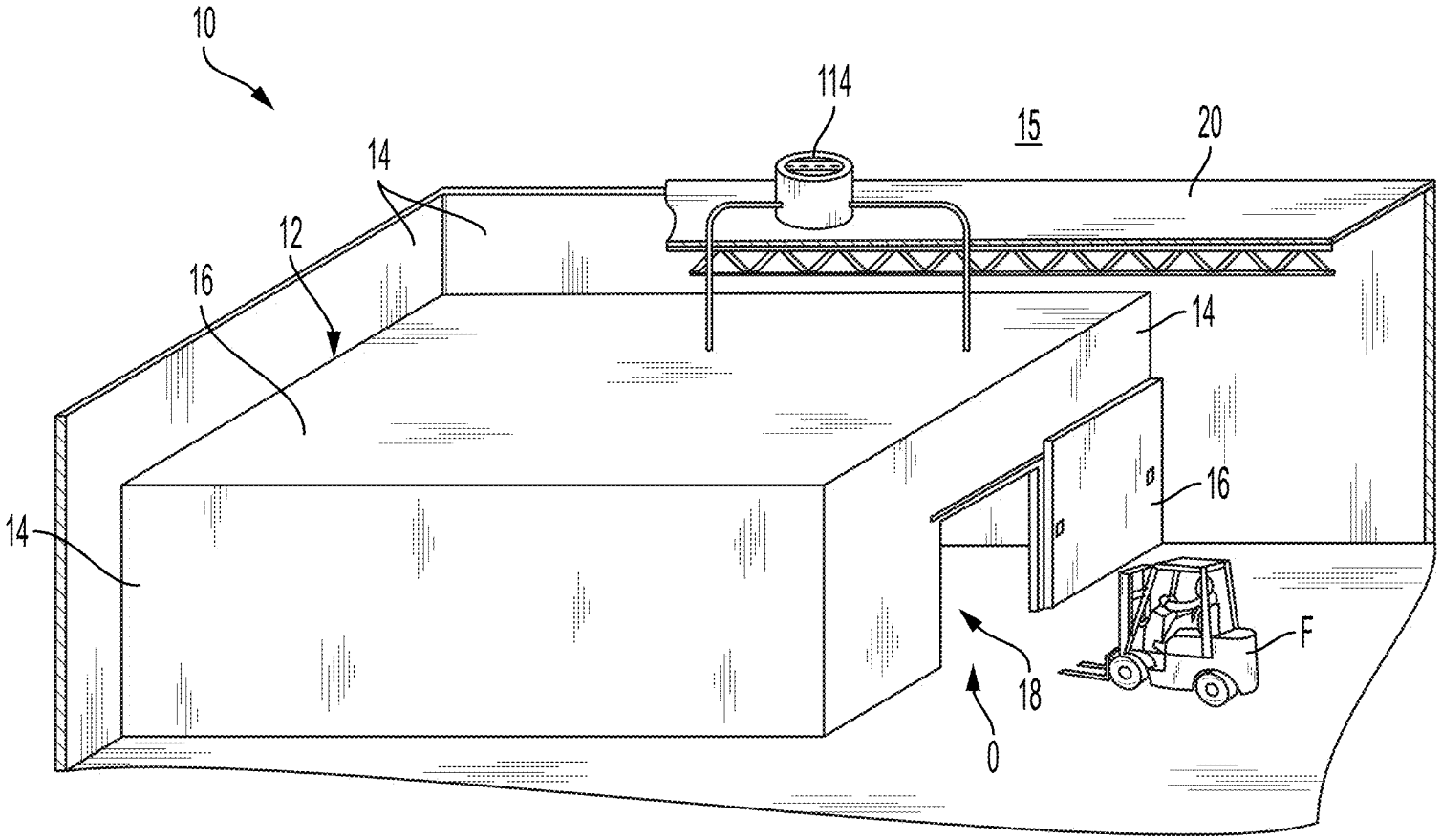
FIG. 1 is a perspective view of a temperature-controlled warehouse in accordance with the present disclosure.

Referring to FIG. 1, system 100 may be integrated into an interior of warehouse 10, which is shown to contain refrigeration housing 12. Housing 12 may enclose a refrigerated space, such as a freezer space as described below. In the exemplary embodiments described herein, refrigeration housing 12 has sufficient internal volume to serve as an industrial sized refrigeration and/or freezing unit. For example, refrigeration housing 12 may include a user access opening O of sufficient length and width for passage of people and equipment therethrough, such as forklift F used to move pallets P (FIG. 2). For purposes of the present disclosure, such an industrial sized refrigeration housing 12 includes insulated walls 14 and insulated ceiling 16 cooperating to provide a ceiling height of at least five feet and/or an internal volume sufficient to house products and walkway space for workers and/or equipment. For example, refrigeration housing 12 may enclose a freezer space defining a conditioned volume of at least 500 cubic feet, and in some embodiments as much as 10,000,000 cubic feet or more.

In the illustrated embodiment of FIG. 1, exterior walls 14 of housing 12 form two of walls 14 which define the lateral boundaries of conditioned space 12. One of walls 14 includes opening O formed therein, with door 16 selectively positionable over opening O to enclose conditioned space 18. Insulated ceiling 16 is also contained within the enclosed volume of warehouse 10, with a separate exterior roof 20 spaced above insulated ceiling 16. In some alternative arrangements, warehouse 10 may have an insulated exterior roof 20 which also forms the insulated ceiling 16. Condenser 114, which forms a part of vapor compression system 110 as further described below, can be disposed on exterior roof 20 in ambient air 15 outside warehouse 10 to avoid exhausting heat into an inside space.

However, it is contemplated that other spatial arrangements for walls 14, ceiling 16, and roof 20 may be utilized as required or desired for a particular application, provided that conditioned space 18 is substantially thermally isolated from ambient air 15, and that conditioned space 18 is substantially sealed from fluid exchange with ambient air 15.

In the context of the present disclosure, "substantially thermally isolated" means a space which is insulated and substantially sealed within reasonable practicable limits. For example, the substantially thermal isolation of conditioned space may mean that a temperature within conditioned space 18 can be maintained at a substantial differential (e.g., in excess of 50 degrees Fahrenheit) by activation of vapor compression system 110.

In the context of the present disclosure, "substantially sealed" means a space which experiences minimal fluid communication with surrounding ambient air within reasonable practicable limits. For example, conditioned space 18 may be a substantially sealed space such that the space 18 experiences less than 10 air changes per hour (ACH), e.g., the volume of air exchange with the ambient environment 15 (or the interior of warehouse 10) is equal to 10 times the volume of conditioned space 18 over the course of one hour. In exemplary embodiments, conditioned space 12 may be sealed to achieve 7, 5, 3 or even 1 ACH.

For purposes of the present disclosure, vapor compression system 110 includes at least a compressor 112, condenser 114, expansion valve 116 and evaporator 118 connected in serial fluid communication with one another to form a vapor compression fluid circuit, with a quantity of condensable refrigerant circulating through the fluid circuit. Compressor 112 provides and, in some embodiments, modulates pressure and circulation of the refrigerant through the fluid circuit. In some embodiments, expansion valve 116 may be an electronic expansion valve (EEV) configured and capable of modulating its throughput based on a signal from controller 102, as further described below.

Figure 3A:
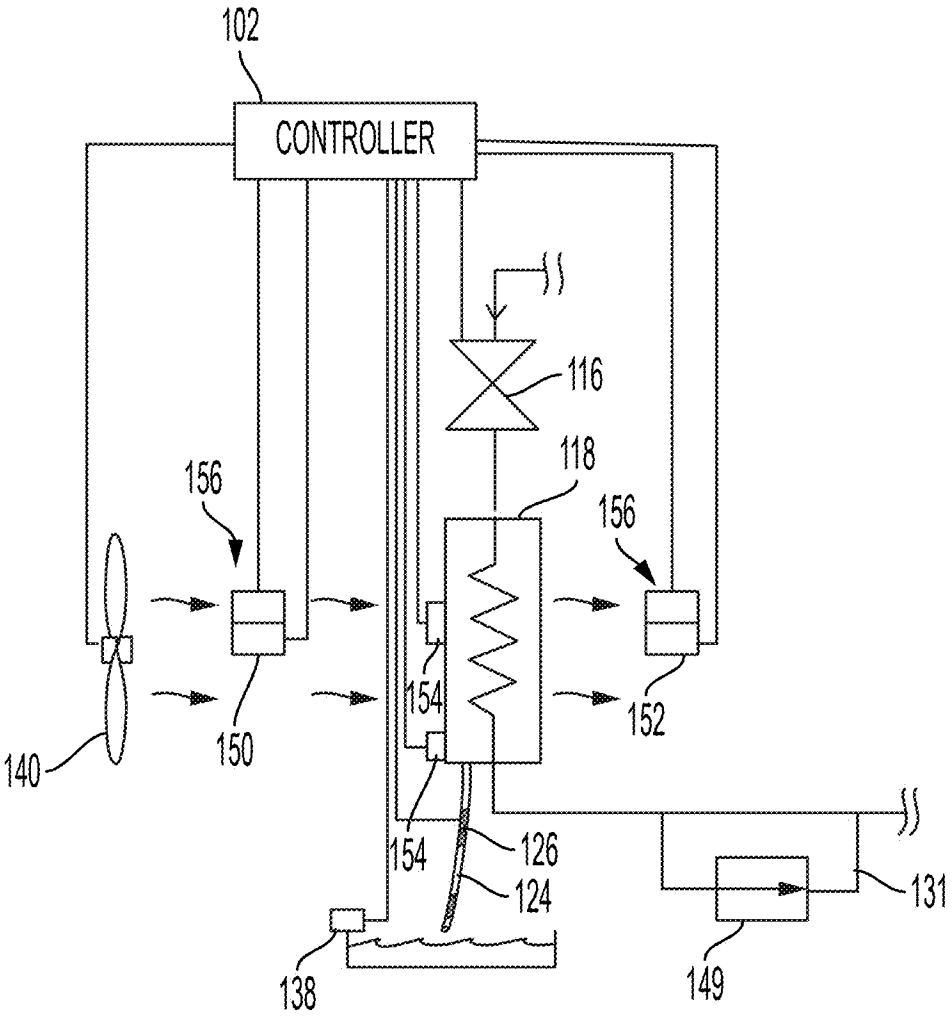
FIG. 3A is an enlarged view of an evaporator configuration in accordance with FIG. 1, together with associated components.
Figure 3B:
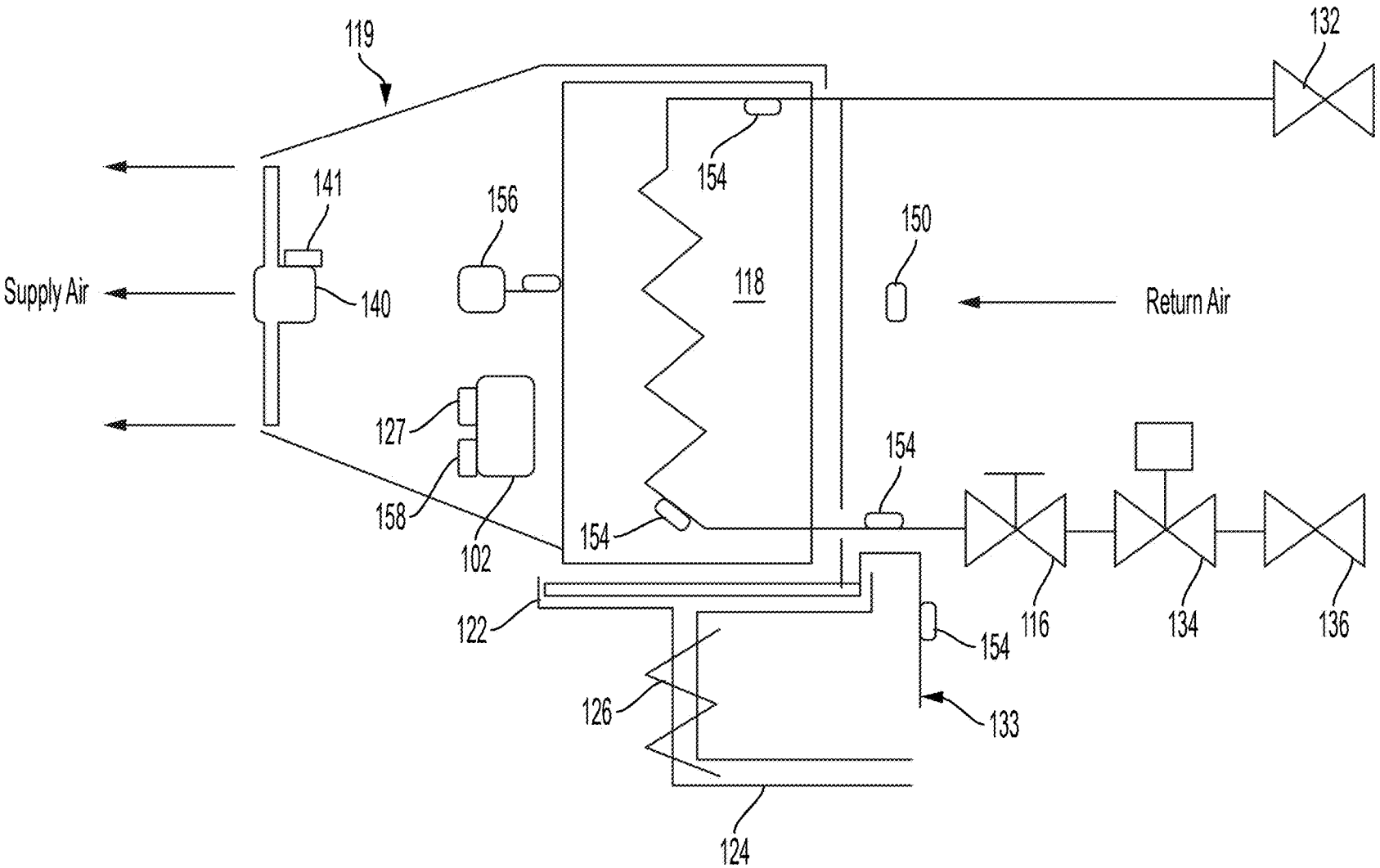
FIG. 3B is another enlarged view of an evaporator configuration in accordance with FIG. 1, together with associated components.
Figure 4:
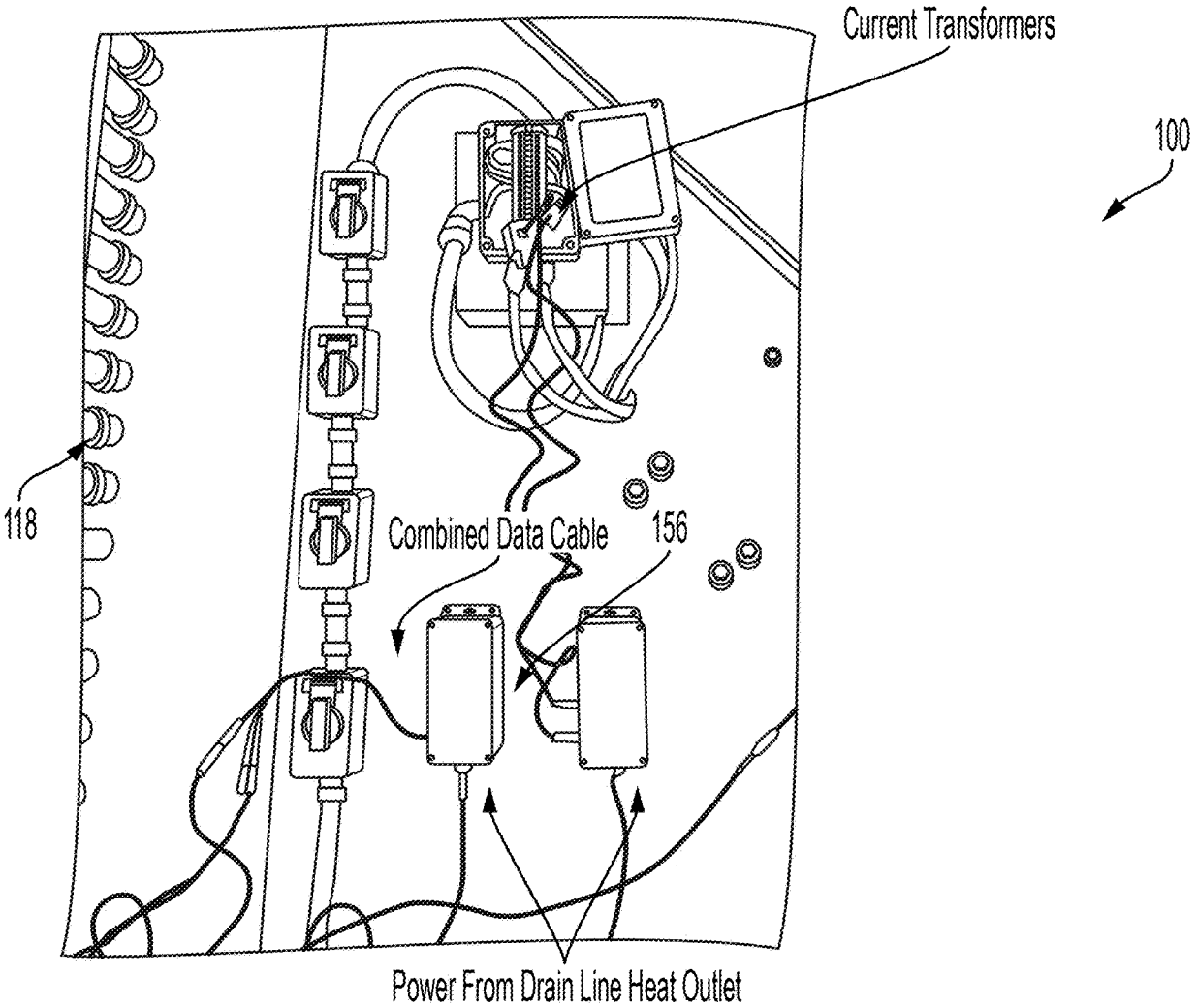
FIG. 4 is a perspective view of certain system components mounted near an evaporator, in accordance with the present disclosure.

Vapor compression system 110 also includes a number of components to enhance and expand its function. These components will be described in additional detail. In particular, evaporator 118 and its associated components facilitate efficient, on-demand defrost cycles which can be terminated based on the actual conditions on and around the coils of evaporator 118. FIG. 3A shows a first detail view of evaporator 118 with such associated components, while FIG. 3B shows a second detail view of evaporator 118 with such associated components. For purposes of the present disclosure, the configurations of FIG. 3A and FIG. 3B are interchangeable within system 100, and all the features shown in one configuration of evaporator 118 is also applicable to the other configuration of evaporator 118. For example, FIG. 3A shows connections between various components and controller 102, it being understood that such connections are also in existence in FIG. 3B, which excludes depictions of such connections for clarity and conciseness. FIG. 3A also shows a "positive pressure" arrangement in which fan 140 orients airflow toward evaporator 118, while FIG. 3B shows a "negative pressure" arrangement in which fan 140 orients airflow away from evaporator 118, creating an area of low pressure within housing 119. Both positive and negative pressure arrangements are contemplated in connection with system 100.

A defrost heater 120 (FIG. 2) may be operably connected to evaporator 118, which can be energized or otherwise activated to heat the coils of evaporator 118, melting any accumulated ice/frost. The resulting liquid is collected in fluid collector 122 positioned under evaporator 112 and evacuated through a drain line 124 extending from the fluid collector to a nearby liquid drain, which in turn has its own heater 126 which can be energized or otherwise activated to melt accumulated ice within the drain line 124 and/or ensure liquid passing through drain line 124 is prevented from freezing.

System 110 may include a series of valves to modulate or toggle flows through the fluid circuit. These may include a suction-stop valve/solenoid 132 may also be included, downstream of the evaporator 118 and upstream of the compressor 112. Suction-stop valve 132 is operably connected to controller 102, and can be activated to slow or stop the flow of fluid through the circuit (e.g., during a defrost cycle). A liquid solenoid 134 may also be provided, downstream of the condenser 114 and upstream of the expansion valve 116. A hot-gas solenoid 130 may admit a flow of hot gasses into evaporator 118 from defrost heater 120 during defrost cycles, as further described below. A liquid strainer 136 configured to arrest pipeline debris, such as scale, rust or other impurities, may also be placed near the liquid solenoid (e.g., either just upstream or just downstream).

Fans may also be provided as a part of system 110 to enhance heat flows. In particular, one or more evaporator fans 140 are positioned and oriented to blow over the coils of evaporator 118 to induce efficient heat transfer from the conditioned (i.e., cooled or frozen) space to the refrigerant. An additional, condenser fan 142 may be similarly positioned and oriented to blow over the coils of condenser 114 to efficiently exhaust heat from the refrigerant to the exterior space outside the conditioned space. Fans 140, 142 have at least a binary on/off functionality controllable by controller 102, but in some embodiments, fans 140, 142 may have continuously controllable motor speeds to modulate airflow according to the programming of controller 102, as described in further detail below.

In the illustrative embodiment shown in FIG. 3B, fan 140 may be contained within an evaporator housing 119, together with evaporator 118 and various sensors as shown. Housing 119 facilitates accurate supply air (i.e., downstream) measurements by confining and separating the supply air from the ambient area within warehouse 10. Controller 102 may, in some cases, also be located within housing 119 as shown in FIG. 3B.

Evaporator fan 140 may include a plurality of temperature sensors, such as an upstream temperature sensor 150 located upstream of the airflow path through evaporator 118, and a downstream temperature sensor 152 located downstream of the airflow path through evaporator 118. As described further below, each sensor 150, 152 is operably connected to controller 102 such that temperature readings on either side of evaporator 118 can be made and compared to measure temperature rise in the airflow passing through evaporator 118.

Evaporator fan 140 also includes a plurality of pressure sensors, such as an upstream pressure sensor 144, positioned downstream of fan 140 (i.e., near an air outlet thereof) and upstream of the airflow path through evaporator 118. A downstream pressure sensor 146 is positioned downstream of the airflow path through evaporator 118. As described further below, each sensor 144, 146 is operably connected to controller 102 such that pressure readings on either side of evaporator 118 can be made and compared to measure pressure drop across evaporator 118.

System 100 may also include vibration monitor 158 (FIG. 3B) operably connected to evaporator 118 or other components within housing 119. Monitor 158 measures and reports vibration values to controller 102, which may in turn display such values via electronic dashboard 200. As described in detail below, vibration monitor 158 may be used for defrost cycle initiation and various other "advisor" type functions.

In some embodiments, a "combined remote sensor puck" 156 may be included with system 100. Puck 156 may include package of sensors sharing a single housing, such that puck 156 can gather multiple types of data from the location where it is installed. For example, puck 156 may include one of the air temperature sensors 150, 152, and one of air pressure sensors 144, 146 from a given location on or near evaporator 118 where puck 156 is installed. Marks from a stencil may be placed on the chosen location for the Puck on a housing of evaporator 118, or in a "penthouse" or upper area of the conditioned space. An installer may then drill the appropriate holes into the sheet metal and mount puck 156 to evaporator 118. A wire from the can then be routed and connected to controller 102, or wireless communication can be established as described herein. Vibration sensor 158, described herein, may also be integrated into the puck 156. In some embodiments, system 100 may also include a refrigerant detector (e.g., a detector of ammonia gas) operably connected to controller 102 to indicate the presence of escaped refrigerant from the fluid circuit within the conditioned space 18 (FIGS. 1 and 2). Such a detector may also be integrated into the puck 156.

System 100 may also include one or more heaters operably coupled to any sensors described herein. For example, such heaters may be provided for sensors expected to endure exposure to warm/moist air during a defrost cycle, such the sensors are prevented from accumulating any condensation/ frost. In one embodiment, system 100 can heat puck 156 whenever a defrost cycle has been initiated and until the cycle has been terminated. This heating modality is particularly advantageous where signals from puck 156 are not needed except during defrost cycles.

2. System Control

As noted above, controller 102 cooperates with the electronic dashboard 200 to provide "advisor" functions, in which the users of system 100 are notified of current or potential issues with system 100, and "commander" functions, in which controller 102 automatically addresses issues through direct control of electronic components of system 100. For purposes of the present disclosure, all commander functions may also be repurposed into advisor functions. That is, a commander function of controller 102 which directly controls a system component (e.g., components used to initiate or terminate an evaporator defrost cycle) may instead be programmed to provide a notification of the need for such control. Such notifications may be provided to an operator who may then take the required action manually (e.g., manual initiation or termination of the defrost cycle).

One exemplary commander function of system 100 is control over evaporator defrost cycles. As noted above, system 100 may include a plurality of sensor components which operate to gather signals indicative of a need for a defrost cycle, and controller 102 may process these signals (as further described below) to initiate the defrost cycle via control over at least one, and in many cases a plurality, of the components of vapor compression system 110.

One data feed which can be used to precisely determine when evaporator 118 requires defrosting is a temperature differential between upstream temperature sensor 150 (i.e., evaporator air supply or inlet) and downstream temperature sensor 152 (i.e., evaporator air return or outlet). When evaporator 118 is frost-free, this temperature differential will have a first, relatively high value owing to the efficient transfer of heat from the fluid circuit of vapor compression system 110 to the air around evaporator 118. As frost accumulates on the coils of evaporator 118, however, this transfer of heat becomes less efficient and the temperature differential between sensors 150, 152 begins to fall because less heat is transferred to the refrigerant in the fluid circuit. As this occurs, controller 102 continuously or periodically monitors the temperature differential to generate an "operational" temperature differential. When the operational temperature differential reaches and/or maintains a second, relatively lower value corresponding to a programmed threshold level below the frost-free temperature differential, controller 102 initiates a defrost cycle (or signal an operator to do so, as noted above). The programmed threshold may be a predetermined temperature value, or may be a predetermined temperature differential below the frost-free temperature value. Additionally, the upstream air temperature measured by sensor 150 may increase as frost builds on evaporator 118, owing to reduced overall efficiency of vapor compression system 110.

In embodiments where system 100 is implemented as a freezer system, ambient temperatures around evaporator 118 may be between −10 F and 10 F, for example. In this type of implementation, the first (i.e., frost-free) temperature differential across evaporator 118 may be between 6.5 degrees F. and 7.5 degrees F., such as about 7 degrees F. When this differential constricts to between 5 degrees F. and 6 degrees F., such as about 5.5 degrees F., controller 102 may be programmed to initiate a defrost cycle.

Another data feed received by controller 102 can be provided from one or more surface temperature sensors 154 in direct thermal communication (e.g., abutting contact) with the coil tubing of evaporator 118. Sensor(s) 154 directly measure the refrigerant temperature at one or a plurality of positions along the tubing, and may ideally be placed at a location significantly downstream of the inlet to evaporator 118, such that significant thermal transfer is expected to have occurred by the time the tubing temperature is measured. Second and subsequent sensors 154 may be progressively further downstream of the first, most-upstream sensor 154. For example, if the location of a sensor 154 is expressed as a percentage of the overall length of the tubing of evaporator 118, with the location being that percentage downstream of the inlet of evaporator 118, then the location(s) may be 50%, 60%, 70%, 80%, 90% or 100% downstream.

FIG. 3B shows one arrangement of evaporator 118 with multiple sensors 154. In particular, an "inlet liquid temperature" may be measured via contact with the coil/tubing at or upstream of the inlet of evaporator 118, where liquid refrigerant is being supplied. Measured with a contact sensor. Then, an "upper coil temperature" may be measured via contact with the coil of evaporator 118 at an upstream location, such as a location between 0-20% downstream of the inlet. Finally, a "lower coil temperature" may be measured via contact with the coil of evaporator 118 at a downstream location, such as a location between 80-100% downstream of the inlet.

When evaporator 118 is frost-free, the temperature signal from sensor(s) 154 will have a first, relatively high value owing to the efficient transfer of heat from the fluid circuit of vapor compression system 110 to the air around evaporator 118. Additionally, if multiple sensors 154 are positioned at different points along the evaporator tubing, a relatively steep drop from upstream to downstream sensor locations will be observed. As frost accumulates on the tubing, an "operational" temperature measured by sensor(s) 154 can be expected to fall as less heat is drawn into the refrigerant due to degradation of heat-transfer efficiency. Additionally, the operational temperature curve created by multiple sensors 154 will "flatten," i.e., less difference between adjacent sensor readings will be observed. When the operational temperature of the coil of evaporator 118 reaches and/or maintains a second, relatively lower value corresponding to a programmed threshold level below the frost-free temperature, controller 102 initiates a defrost cycle. Alternatively, when the steepness of the temperature curve reaches a threshold low (i.e., flattened) level, controller 102 initiates a defrost cycle.

Controller 102 may also use signals received from sensors 154 to determine if the (liquid) refrigerant is properly distributed throughout the coil of evaporator 118. "Upper coil temperature" measured by sensor 154 shown in FIG. 3B and described above will show a temperature similar to the upstream "inlet liquid temperature" sensor 154 during normal operation. However, when insufficient liquid is being supplied to evaporator 118, phase change may be completed between these two upstream sensors 154, leading to a rise in temperature between in the inlet sensor 154 and the upper coil sensor 154. When this is observed by controller 102, a "poor distribution" alarm may be generated to indicate insufficient opening of expansion valve 116, and/or insufficient liquid pressure is present due to poor performance of compressor 112, a restricted liquid strainer 136 (FIG. 2), and/or a combination of these.

Air temperature differentials measured by sensors 150, 152 may be combined with coil temperatures measured by sensor(s) 154, such that air temperature differential across evaporator 118 may be monitored and expressed as a function of the measured temperature of refrigerant within evaporator 118. For example, as shown in FIG. 3B, temperature sensors 154 may be provided upstream of the inlet of evaporator 118, at an upstream end of the coil of evaporator 118, and near an outlet of the evaporator 118. One or both of the upstream sensors 154 may provide an evaporating temperature at the coil. The air temperature differential measured by sensors 150, 152 may be a given percentage of the temperature differential observed between the upstream sensors 154 and upstream air temperature sensor 150. For example, the air temperature differential may be between 40-60%, such as about 50% of the coil/supply air temperature differential. In a freezer example, the temperature measured by upstream sensors 154 on the coil of evaporator 118 may typically be about −10° F., while return air temperature measured by upstream sensor 150 may be about 0° F. In this instance, supply air temperature measured by downstream sensor 152 may be expected to be between −4° F. and −6° F., such as about −5° F. If controller 102 calculates a temperature differential at a threshold level below the expected differential (e.g., below 40%), a defrost cycle may be initiated and/or a "poor-performance" alert may be issued to dashboard 200.

In embodiments where system 100 is implemented as a freezer system as described above, the first (i.e., frost-free) temperature on evaporator 118 may be between −10 degrees F. and −15 degrees F. When this temperature lowers to a second level between −15 degrees F. and −20 degrees F., such as about-18 degrees F., controller 102 may be programmed to initiate a defrost cycle.

Another data feed confirmed by change in electrical current drawn by the motor of fan 104 to maintain a given blade speed of evaporator fan 140. This current may be monitored, for example, via a current transformer 141 operably connected to the motor of fan 140, as shown in FIG. 3B. When evaporator 118 is frost-free, air blown by fan 140 passes relatively easily across the coils and the motor of fan 140 maintains a first, relatively lower electrical current draw to maintain a given setpoint speed. As frost builds on evaporator 118, the frost presents a physical barrier to air movement across the coils, and the electrical current draw increases for the setpoint speed. When the amperage draw of fan 140 reaches and/or maintains a second, relatively higher value corresponding to a programmed threshold level above the frost-free amperage, controller 102 initiates a defrost cycle. In some embodiments, the second amperage value may be 2-5% higher than the first amperage value.

In embodiments where system 100 is implemented as a freezer system as described above, the first (i.e., frost-free) current drawn by fan 140 may be between 11 amps and 12 amps. When the operational current rises to a second level of at least 12.5 amps, controller 102 may be programmed to initiate a defrost cycle.

Current transformer 141 may also provide advisory functions to warn of poor performance or impending failure of a fan, such as evaporator fan 140. When the amperage draw becomes higher than historical readings, an "out of tolerance" condition may be activated by controller 102, which in turn may issue a signal indicative of this out-of-tolerance condition. For example, a failure of a bearing operably disposed between the fan motor and the fan blade will generally be preceded by a current draw that is substantially above any current drawn by that fan during past operation. Such high current draws, which may be at least 10% above the past range of current draws recorded by controller 102, may prompt controller 102 to generate an alarm. Advantageously, this monitoring system can be used for all fans 140 used in connection with all evaporators 118 in a given system 100. Where one evaporator 118 is served by multiple fans 140, failure of a single fan 140 or subset of fans 140 may be detected even when the remaining operational fans 140 continue to move air across evaporator 118. In this way, an operator of system 100 can be notified of a failure of a fan 140 where such failure might otherwise go unnoticed as evaporator 118 continues to function (albeit at a lower performance level) with the other fans 140.

Vibration monitor 158 (FIG. 3B) may also be used to initiate a defrost cycle. Controller 102 may monitor vibration of evaporator 118 or other components within or fixed to housing 119 for change over time. As frost builds on the coils of evaporator 118, vibration may steadily increase from an original, frost-free baseline. When evaporator 118 is frost-free, vibration may average a first, relatively lower level which is registered by controller 102 as the baseline. As frost builds up, the amplitude of the vibrations may increase, with time-averaged amplitudes rising steadily from the baseline to a predetermined threshold above the baseline. This threshold may be programmed at between 10-25% higher than the baseline, such as about 15% or about 20%, for example. Time-averaging may be performed with on a rolling basis, with the time period of the average being between 4 and 24 hours, it being understood that the time average may be adjusted within the programming of controller 102 depending on the expected rapidity of frost buildup. When the threshold average amplitude is reached, controller may be programmed to initiate a defrost cycle.

Yet another data feed for determining the time of defrost initiation is air pressure differential across the coils of evaporator 118. When evaporator 118 is frost-free, air blown by fan 140 creates a first, high pressure at the air inlet of evaporator 118, and this is measured by upstream pressure sensor 144. Meanwhile, a second, lower pressure is recorded at the air outlet of evaporator 118, and this is measured by downstream pressure sensor 146. The differential between the upstream and downstream measurements is relatively low during frost-free operation, as air moves relatively easily across the coils of evaporator 118. As frost builds on evaporator 118, the spaces between adjacent coil fins on evaporator 118 narrows. In this way, the frost presents a physical barrier to air movement across the coils, as also noted above with respect to the current drawn by fan 140. This barrier, in turn, creates a larger pressure differential between upstream pressure sensor 144 and downstream pressure sensor 146. When this pressure differential reaches and/or maintains a second, relatively higher value corresponding to a programmed threshold level above the frost-free pressure differential, controller 102 initiates a defrost cycle.

Pressure differential may be expressed, for example, as a percentage of a baseline, such as 1,000 hPa, which is approximately a typical ambient pressure expected to be in existence around system 100. The differential across an exemplary frost-free evaporator 118 may be between 70% and 75% of this baseline, for example, or may be within any range defined by any of the foregoing values. A threshold for controller 102 to initiate a defrost cycle may be as low as 85%, 90%, or as high as 95% or 98%, for example, or within any range defined by any of the foregoing values. Accordingly, it can be seen that pressure differential as measured by sensors 144, 146 provides a clear and unequivocal signal corresponding to the existence and extent of frost on the coils of evaporator 118, allowing controller 102 to be programmed for highly efficient operation of vapor compression system 110. Alternatively, where controller 102 is operating in an "advisor" rather than "commander" mode, controller 102 may enable a well-informed and highly efficient decision on manual defrost initiation by an operator.

In general, it is understood that the measured pressure differential will vary depending on the configuration of system 100, and particularly on the configuration of evaporator 118. In some embodiments, a change of at least 100 hPa may be a sufficiently clear signal to initiate a defrost cycle. In other embodiments, a change of 125 hPa, 150 hPa, 175 hPa or 200 hPa may be sufficient and/or optimal to initiate a defrost cycle.

Controller 102 may be programmed to use any of the foregoing parameters independently to initiate a defrost cycle. Controller 102 may alternatively be programmed to use any group of the foregoing parameters in combination, as required or desired by a particular application. For example, in some applications a single parameter may be deemed sufficient for the level of overall system efficiency desired. In other applications, only a limited suite of sensors may be present to provide signals to controller 102, in which case only the date from the available sensors is utilized by controller 102. In yet other applications, all or most of the foregoing parameters may be used to maximize the efficiency and performance of system 100.

In one exemplary embodiment, pressure sensors 144, 146 may be the only, or the primary, provider of data to controller 102. Other sensor data, such as temperature and electrical current data as described above, may be used only to validate the signals received from pressure sensors 144, 146, or such data may be excluded entirely.

When controller 102 determines a defrost cycle should be initiated as described in detail above, controller 102 issues signals to one or more components of vapor compression system 110 to effect the defrost cycle. For example, compressor 112 may be deactivated while defrost heater 120 is activated. Stop valve 132 may be simultaneously activated to halt the circulation of refrigerant. Expansion valve 116 may also be controlled to limit flows of refrigerant to evaporator 118 during the defrost cycle, such as to ensure some fluid availability to evaporator (to promote efficient heat transfer during defrost) while avoiding excess fluid (to avoid liquid refrigerant from being transmitted to compressor 112 upon termination of the defrost cycle). Fan 140 may also be deactivated by controller 102 upon initiation of the defrost cycle.

In one exemplary embodiment, defrost heater 120 may be a hot gas type heater which injects and circulates heated gas into evaporator 118 via hot gas solenoid 130 during the defrost cycle, allowing the otherwise "wasted" heat in residual discharge vapor from compressor 112 to be routed into the evaporator 118, as described in detail below. When the cycle is terminated, solenoid 130 is closed. Alternatively, defrost heater 120 may be an electric heater in physical contact with the coils of evaporator 118. This electric heater generally draws a high current (typically, several times higher than the current drawn by fan 140), but electric heating is suitable for conditioned spaces below 36 F, including freezers. Yet another alternative is air defrosting, in which liquid solenoid 134 is closed while fan 140 remains active. Air defrosting may be used where the target temperature in the conditioned space is 36 F and above.

For hot-gas type defrost cycles, several steps may be performed in a specific sequence for safety and effectiveness. A first step, referred to as the "Pump-Out" step herein, addresses the liquid charge already present in evaporator 118, including situations where evaporator 118 is overfed or flooded with liquid, such that liquid or overly saturated gas is reaching the outlet/return of evaporator 118. During the Pump-Out step, liquid solenoid 134 is closed while the suction stop valve/solenoid 132 remains open and the fan 140 continues to run. This step helps vaporize as much of the residual liquid prior to opening the hot-gas solenoid 130.

A second step, referred to as the "Hot-Gas Mode" step herein, immediately follows the Pump-Out step. During Hot-Gas Mode the suction stop valve/solenoid 132 is closed and the fan 140 is stopped. Subsequently, hot-gas solenoid 130 opens, allowing discharge vapor to enter the coil of evaporator 118. Coil pressure rises and the vapor condenses while heating the inner tube surfaces and the coil overall. The pressure of the hot gas admitted to evaporator 118 may be limited by an inlet pressure regulator 148 which opens when the pressure in evaporator 118 eclipses the regulator's setting, typically typical 75 psig for ammonia gas. At this time, the mixture of condensed liquid and vapor is "relieved" into a suction line. Alternatively, a liquid drainer 131 may be provided with an outlet pressure regulator 149, as shown in FIG. 3A. Regulator 149 maintains the defrost pressure in evaporator 118 and liquid drainer 131 allows liquid to pass out of evaporator 118 and into a suction line.

A third step, referred to as the "Bleed" step herein, immediately follows the Hot-Gas Mode. In the Bleed step, pressure within the coils of evaporator 118 is reduced (i.e., bled-down) over a period of time before the suction-stop valve/solenoid 132 is opened. At the end of the Hot-Gas Mode, the pressure in evaporator 118 is typically close to 75 psig (depending on refrigerant used and the configuration of regulators 148 or 149. Meanwhile, the suction pressure at the inlet of compressor 112 may be 0 psig or lower. The Bleed step allows the pressure difference to be reduced to a predetermined threshold (e.g., over several minutes, such that the pressure difference is less than 10 psig) so when suction stop valve/solenoid 132 is open, the resulting "rush" of vapor/liquid is minimized or eliminated.

A fourth and final step, referred to as the "Refreeze" step herein, immediately follows the Bleed step. The main suction valve/solenoid 132 is opened and the liquid solenoid 134 is opened while the fan 140 remains off. This enables any residual moisture on the coil to be "refrozen" prior to the fans coming back on. This step prevents water from being blown off of coil surfaces and refrozen on the floor or perhaps the fan blades, upon activation of fan 140.

Controller 102 may monitor the performance of the defrost cycle. For example, the temperature of the hot-gas defrost pipe may be monitored via a contact sensor 154, shown on the hot-gas inlet line 133 in FIG. 3B. If the hot-gas solenoid 130 has failed to open, for example, the expected rise in temperature measured by contact sensor 154 will fail to materialize after a predetermined time programmed into controller 102. When such failure to raise temperature is observed by controller 102, a defrost failure alert may be issued by controller 102, e.g., via dashboard 200. Additionally, the "lower coil temperature" sensor 154 (shown in FIG. 3B and described above) is monitored by controller 102 during the defrost cycle. When this temperature rises to a predetermined temperature, such as a temperature above freezing, it can be assumed that the frost has melted from the coils of the evaporator 118 and controller 102 may then terminate the defrost cycle.

During or before the initiation of a defrost cycle, controller 102 may record or otherwise monitor a current (i.e., real-time) measurement of the condition of condensate drain line heater 126, such as activation status and temperature.

Controller 102 is programmed to activate the condensate drain line heater 126 in concert with the initiation of the defrost cycle. In one embodiment, drain line heater 126 is activated by controller 102 at the same time as the defrost heater 120. In another embodiment, drain line heater 126 is activated by controller 102 at a predetermined time before the initiation of a defrost cycle. To accomplish this, controller 102 may be programmed with a threshold for activation of drain line heater 126 that is functionally earlier in time as compared to the threshold for initiation of the defrost cycle. Therefore prior to defrosting the evaporator 118, controller 102 powers the drain line heater 126 to ensure drain line 124 is sufficiently heated to prevent ice formation when the defrost cycle is initiated. Relatedly, drain line heater 126 may be deactivated upon termination of the defrost cycle (e.g., when defrost heater 120 is deactivated, as described further below), or drain line heater 126 may remain energized for a predetermined period of time after the termination of the defrost cycle to ensure complete drainage of liquid condensate.

For example, where temperature differential is used as the determinant of defrost initiation, drain line heater 126 may be activated when the observed temperature differential is lower than the frost-free value but higher than the defrost-initiation value. Similarly, for other defrost initiation determinants, the drain line heater 126 may be activated at a value or value set that is between the frost-free condition and the defrost-initiation condition. In this way, energy for drain line heater 126 can be used judiciously to adequately raise the drain line temperature prior to defrosting and maintain the temperature during the defrost and drain periods. At all other times, the drain line heater 126 may be deactivated to avoid unnecessary energy use.

Controller 102 also determines when the defrost cycle should be terminated and, upon such determination, a termination signal is issued. Termination may be effected when coil temperature sensor 154 issues a temperature reading above freezing for a predetermined period of time, such as 5 minutes, 10 minutes or 15 minutes, for example. This temperature may be particularly monitored at the "lower coil temperature" sensor 154 as noted above. Alternatively, the defrost cycle may be set to proceed for a predetermined time period monitored by a timer of controller 102, and the termination signal may be issued upon expiration of the time period.

Controller 102 is programmed to exert control over all the electronically-connected components of system 100, including compressor 112, condenser 114, expansion valve 116 and evaporator 118. Additionally, controller 102 may be programmed to exert control over additional components of the vapor compression system 110, such as liquid pumps, level controls and ancillary heating systems, such as under floor heating systems.

Controller 102 is also programmed, as described above, to selectively activate or deactivate other components of system 100, including all valves and solenoids. Controller 102 may modulate some components, as opposed to binary on/off control, as appropriate. Such modulation may be used for expansion valve 116 to control the flow rate of refrigerant through vapor compression system 110, as described herein. Fan speeds may also be modulated, such as the speeds of evaporator fan 140 and/or condenser fan 142.

In one embodiment, controller 102 may be connected by WiFi to some or all of the components under control, though of course hard-wired connections may also be made. Controller 102 may be self-powered, i.e., with an independent electrical connection to source power with an optional battery backup.

Because system 100 monitors several critical points on the evaporator needed to make the precise defrosting determinations, it is also able to communicate, such as via dashboard 200, any "Out-Of-Tolerance" observed conditions. Such Out-Of-Tolerance conditions may be relayed as part of the set of advisor functions programmed into controller 102.

Figure 5:
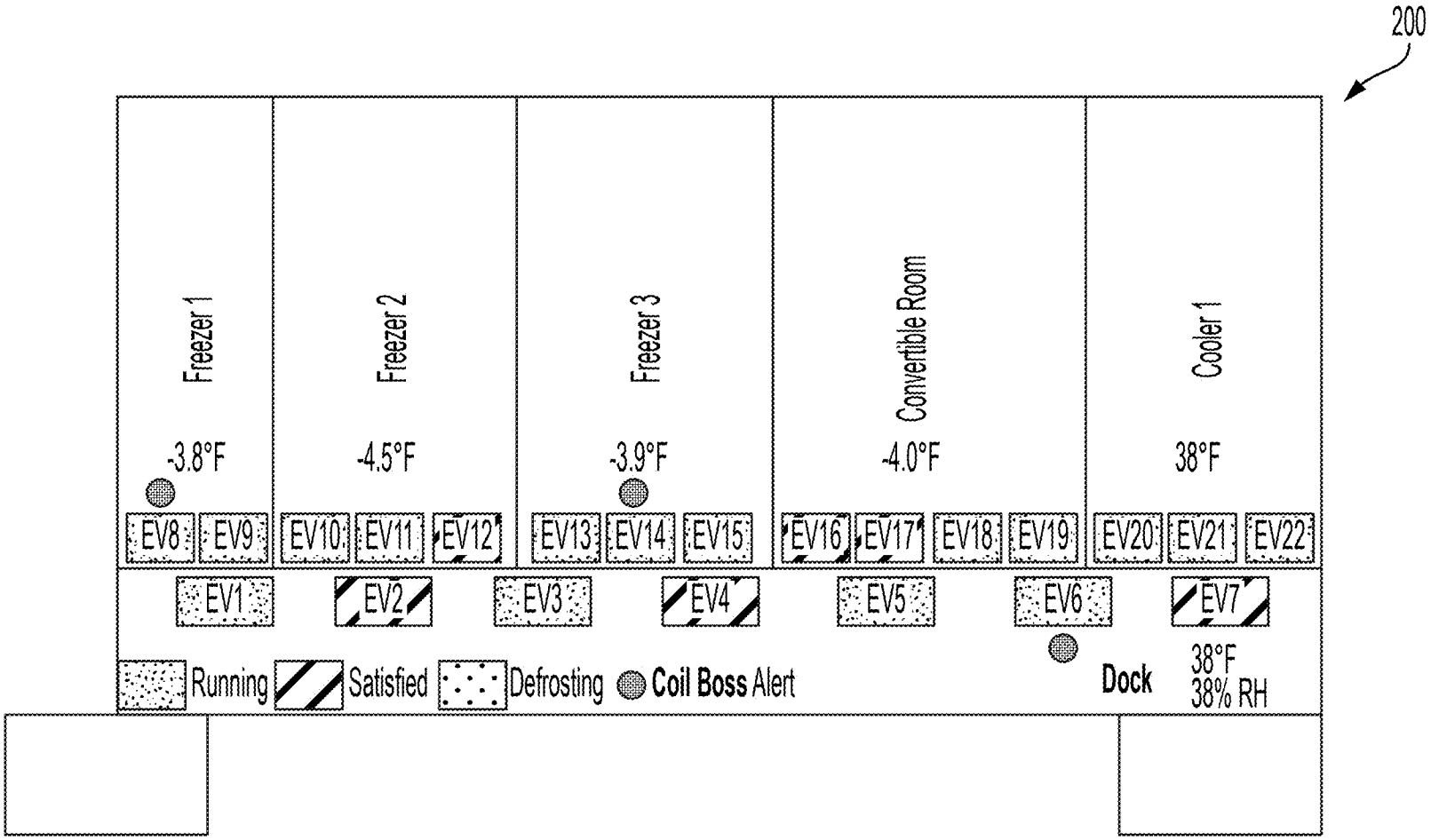
FIG. 5 is an electronic dashboard in communication with a controller made in accordance with the present disclosure.
Figure 6:
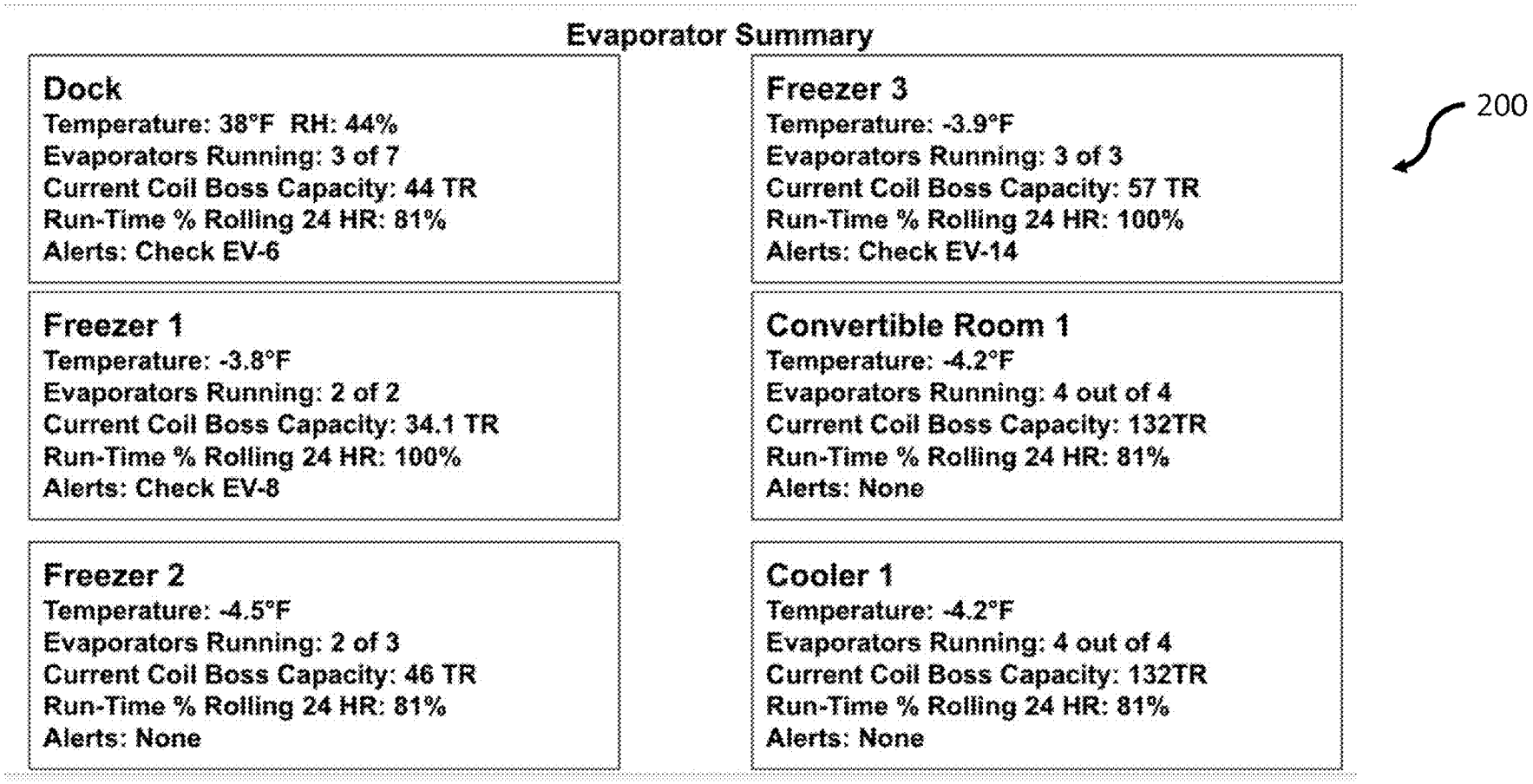
FIG. 6 is an electronic dashboard in communication with a controller made in accordance with the present disclosure.
Figure 7:
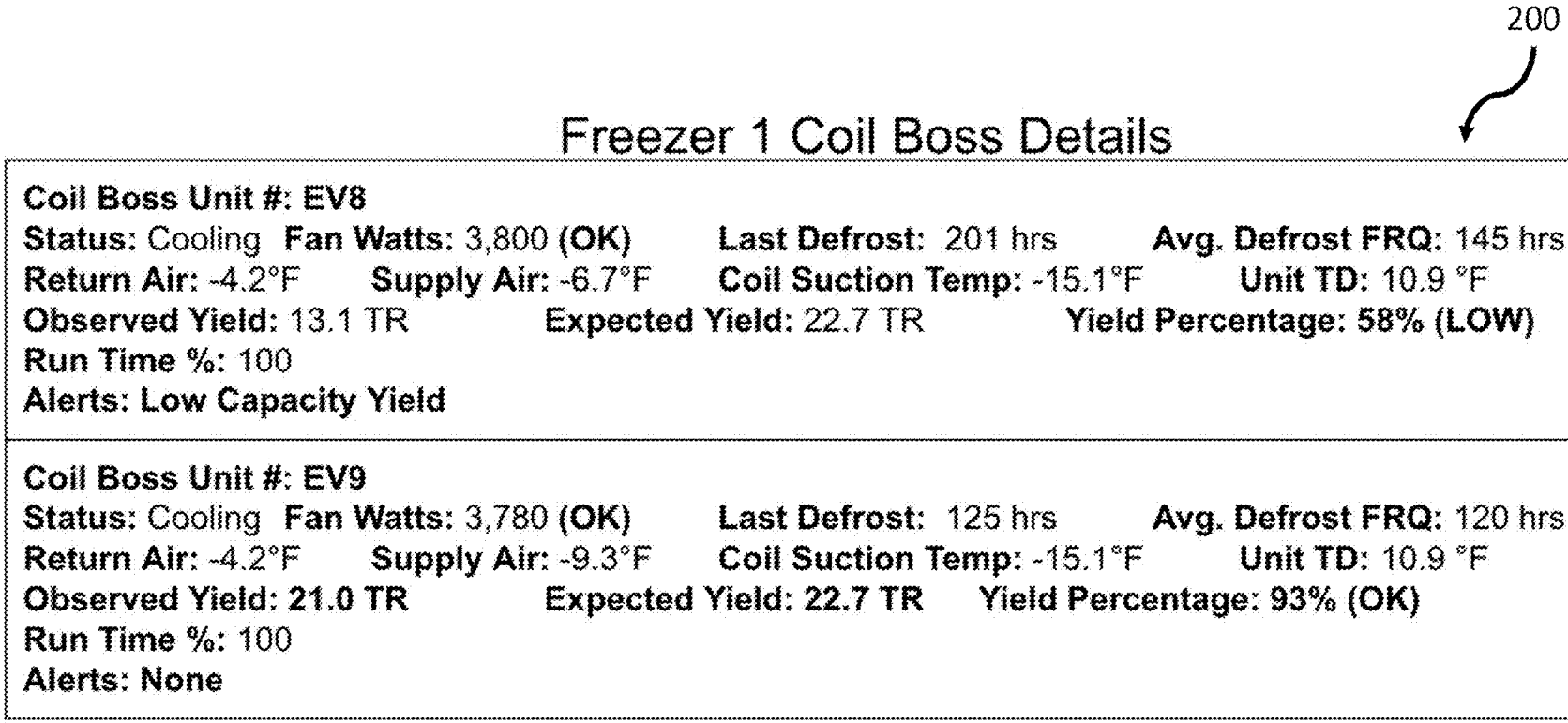
FIG. 7 is an electronic dashboard in communication with a controller made in accordance with the present disclosure.

Advisor functions allow controller 102 to provide notifications to an operator or technician responsible for system 100. Advisor functions are issued by controller to a display, such as a display operably connected to or integrated in electronic dashboard 200, which prompt the operator or technician to remedy any minor problems before they cause or otherwise lead to bigger problems. For example, FIG. 5 shows a display screen for dashboard 200 with a series of evaporators under monitoring, from a first evaporator "EV1" to a twenty-second evaporator "EV22." Each evaporator is located within a defined conditioned space, including three freezers, a convertible room, a cooler, and a dock. Dashboard 200 shows whether each evaporator EV1-EV22 is running, satisfied (i.e., maintaining a desired temperature without assistance from the vapor compression system), or defrosting. Additionally, three of the evaporators—EV6, EV8, and EV14—have a "Coil Boss Alert" indicating there is an advisor function currently active. FIG. 6 shows another display screen for dashboard 200 with more detailed information from the sensors in each conditioned space, including current temperature, relative humidity ("RH") for spaces above freezing, the status of the evaporators in each conditioned space, capacity, the percentage of run time for the vapor compression system as compared to the total time of the previous 24 hours, and the identity of any evaporators under alert (i.e., for which an advisor function is active). FIG. 7 shows additional detail for two specific evaporators, including status as mentioned above, wattage draw, time since last defrost cycle, average time between defrost cycles, air temperatures as measured by upstream and downstream sensors 152, 154, a coil temperature sensor as measured by sensor 154, and expected versus observed cooling yield with a percentage therebetween. If the cooling yield is sufficiently lower than expected, an alert may be generated as shown for evaporator EV8 of FIG. 7.

For example, controller 102 may monitor drain line heater 126 for failed drain line heat tracing. This may be accomplished, for example, by monitoring electrical current to drain line heater 126 and inferring malfunction when the current shows a completely open or closed circuit (e.g., zero current or overcurrent). For example, current transformer 127 may be provided to power heater 126, as shown in FIG. 3B. When current transformer 127 reports electrical current draw below a threshold or below historical norms, malfunction of heater 126 may be determined. Alternatively, temperature monitors on drain line 124 may be used to determine heater 126 is malfunctioning. When such malfunction is detected, controller 102 may issue a notification indicative of a malfunctioning heater 126. In one exemplary embodiment, controller 102 may also prevent initiation of a defrost cycle when drain line heater 126 is malfunctioning, thereby preventing condensate from being created unless and until drain line heater 126 is able to ensure drain line 124 is clear. Controller 102 may delay initiation of the defrost cycle until drain line heater 126 again draws a normal operating current or is otherwise determined to be functional by cessation of the malfunction-indicative signal. This prevents the defrosting of the evaporator 118 with a frozen drain line, thereby avoiding a difficult cleanup if heated condensate is allowed to overflow.

Similarly, controller 102 can detect a failed hot-gas solenoid 130 and/or defrost heater 120 by a lack of an increase in temperature at the coils of evaporator 118, and upon such detection, issue a notification. A failed suction-stop valve/solenoid 132 may similarly be detected by controller 102 by a failure to detect warming in the evaporator 118 during defrost cycles. A refrigerant leak at evaporator 118 may similarly be detected by out-of-specification performance values, particularly with regard to expected temperatures as compared to observed temperatures.

A clogged liquid strainer 136, and/or inadequate refrigerant feed/distribution to evaporator 118 may be detected by a low- or zero-value temperature differential, out of normal operational specifications, as measured and reported from temperature sensors 150, 152, or by coil temperature sensor 154, as also described above. This may cause controller 102 to issue a notification, such as to dashboard 200, indicative of low or inadequate refrigerant flow through evaporator 118. A failed liquid solenoid 134 may also be diagnosed by such a low-flow notification.

A failed or failing motor of evaporator fan 140 may be detected by out-of-specification electrical current values being drawn by fan 140. An obstructed coil of evaporator 118, or an obstructed fan 140, may be detected by a low- or zero-value temperature differential, out of normal operational specifications, as measured and reported from temperature sensors 150, 152. Additionally or alternatively, an obstructed coil or fan 140 may be detected by a high-value pressure differential, out of normal operational specifications, as measured and reported from pressure sensors 144, 146.

The advisor functions of controller 102 may also take the form of real-time reporting on the current operational state of system 100. For example, electronic dashboard 200 may display observed evaporator capacity, typically displayed as a measure of thermal energy currently being removed by the evaporator 118. This capacity may be calculated by controller 102, as a function of the signals available from the sensors of vapor compression system 110 described above. This capacity could also be displayed on electronic dashboard 200 as a percentage value of the expected or "catalog" capacity of the particular evaporator 118 used in system 110.

Controller 102 may generate a notification if vibration values measured by vibration monitor 158 rise above a predetermined threshold (e.g., an "out of tolerance" vibration reading) programmed into controller 102. In some cases, above-threshold vibration can occur as a result of a faulty fan blade or motor of fan 140, but can also occur as a result of increasing frost accumulation on the coils of evaporator 118. Where vibration monitor 158 measures vibration changes consistent with an impending failure of fan 140, such as a sudden increase in vibration which can be associated with a failing bearing, an alarm may be issued by controller 102 to help prevent catastrophic failure.

3. System Performance

As described in detail above, system 100 and controller 102 are configured to monitor components, especially evaporator 118, for signs of excess frost and the resulting degradation in system performance. By ensuring that defrost cycles are initiated when needed, terminated when appropriate, and not initiated when not needed, system 100 maximizes available evaporator run time, thereby maximizing the overall capacity of vapor compression system 110 to remove heat from the conditioned space. Relatedly, the amount of heat added to the conditioned space in connection with defrost cycles is minimized to only those times when a defrost operation is actually needed to remove excessive frost on the coils of evaporator 118.

This, in turn, allows vapor compression system 110 to be operated as the highest possible suction pressure, because evaporator 118 may be assumed to be operating at or near its peak performance. Controller 102 can therefore be programmed to operate compressor 112 at a higher suction pressure than might otherwise be possible without the present defrost control modalities. Moreover, because peak evaporator performance may be assumed with system 100, system 100 may be sized smaller than would otherwise be possible, saving money and resources in the initial specification and installation of a new system 100 to meet given performance requirements for a particular space and operation.

Additionally, system 100 can be expected to automatically adjust to changing ambient conditions. Such changing conditions may be variable weather, changes in the frequency and duration of operators accessing the conditioned space, and variations in the condition, quantity and quality of good stored in the conditioned space.

Electronic dashboard 200, in addition to displaying relevant information from controller 102, may be used to program controller 102 within certain parameters. For example, operators may be allowed set up and change defrost schedules and duration of each defrost step, as desired, from dashboard 200. A user of dashboard 200 may also limit the number of evaporators 118 to be in a defrost cycle at any given time. For example, in large, multi-evaporator system 100, controller 102 may be programmed to allow up to two or three evaporators 118 to enter a defrost cycle concurrently, depending on system size. Any other evaporators 118 in the system 100 which are subject to initiation of a defrost cycle (either by controller 102, as described above, or by a manual prompt from an operator) are placed in a queue to be defrosted as other evaporators complete their defrost cycles.

System 100 delivers the operational efficiency described above while also promoting robust adoption by technical and business personnel. When operators of a system that has already been commissioned can use dashboard 200 to view system operation and any recommendations/automatic operations generated by controller 102. As controller 102 repeatedly provides sound recommendations and/or automatic operations that adjust to changing ambient conditions, the operators and business personnel can trust that the good stored in the conditioned space are being well-protected without undue waste or inefficiency. Moreover, the programming of controller 102 provides accurate and efficient defrost-initiation and defrost-termination signals regardless of the style of evaporator used or the location of the evaporator, thereby ensuring efficient operation despite differing defrost demands. Other unusual conditions include pull-down, i.e., the initial commissioning of system 100 and the related removal of heat and moisture from the conditioned space, which will generate very high initial demand for defrost followed by a sharp reduction. High traffic locations and operations will also show high defrost demand, while low use periods such as weekends will show low defrost demand. System 100 and controller 102 can flexibly meet these demands while avoiding or minimizing unnecessary energy expenditure on defrost cycles.

4. Controller/Computing

Figure 8:
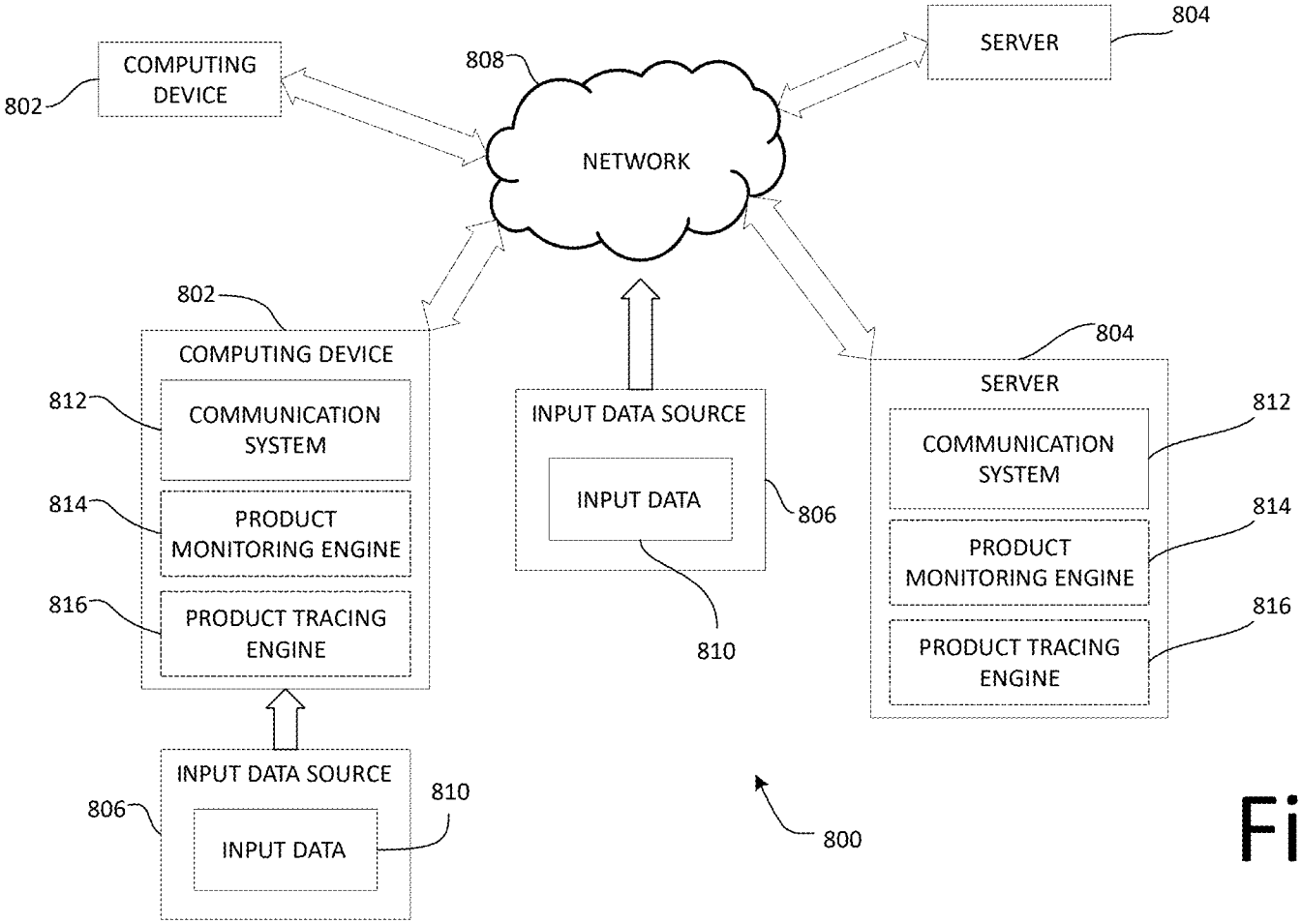
FIG. 8 is a schematic control system in accordance with the present disclosure.

FIG. 8 shows an example of a system 800 including an external/centralized system as described above in accordance with some aspects of the disclosed subject matter. The system 800 may be a system for monitoring and controlling sensors, valves and the like in connection with a vapor compression system, including system 100 described above or a similar configuration. The system 800 includes one or more computing devices 802, one or more servers 804, one or more input data sources 806, and a communication network or network 808. In some examples, the computing device 802 can receive input data 810 from the input data source 806. Additionally, or alternatively, in some examples, the network 808 can receive input data 810 from the input data source 806.

In some examples, computing device 802 includes a communication system 812, product monitoring engine or component 814, and/or a product tracing engine or component 816. In some embodiments, computing device 802 can execute at least a portion of the product monitoring engine 814 to receive temperature data corresponding to a product based on the input data 810. In some examples, the computing device 802 can execute at least a portion of the product tracing engine 816 to determine a user (e.g., employee) to whom a notification regarding the product should be sent. In some examples, the communication system 812 includes a wireless transmitting module which, when executed by a processor, enables transmissions relating to one or more temperature readings.

In some examples, server 804 includes a communication system 812, product monitoring engine or component 814, and/or a product tracing engine or component 816. In some embodiments, server 804 can execute at least a portion of the product monitoring engine 814 to receive temperature data corresponding to a product based on the input data 810. In some examples, the server 804 can execute at least a portion of the product tracing engine 816 to determine a user (e.g., employee) to whom a notification regarding the product should be sent. In some examples, the communication system 812 includes a wireless transmitting module which, when executed by a processor, enables transmissions relating to one or more sensor readings or other component data as described above.

Additionally, or alternatively, in some examples, computing device 802 can communicate data received from input data source 806 to the server 804 over a communication network 808, which can execute at least a portion of the product monitoring component 814 and/or the product tracing component 816. In some examples, the product monitoring component 814 executes one or more portions of methods/processes disclosed herein and/or recognized by those of ordinary skill in the art, in light of the present disclosure. In some examples, the product tracing component 816 executes one or more portions of methods/processes disclosed herein and/or recognized by those of ordinary skill in the art, in light of the present disclosure.

In some examples, computing device 802 and/or server 804 can be any suitable computing device or combination of devices, such as a controller, desktop computer, a vehicle computer, a mobile computing device (e.g., a laptop computer, a smartphone, a tablet computer, a wearable computer, etc.), a server computer, a virtual machine being executed by a physical computing device, a web server, etc. Further, in some examples, there may be a plurality of computing devices 802 and/or a plurality of servers 804.

In some examples, input data source 806 can be any suitable source of input data (e.g., data generated from a computing device, data stored in a repository, data generated from a software application, data received from a motor, data received from a sensor, etc.). In some examples, input data source 806 can include memory storing input data (e.g., local memory of computing device 802, local memory of server 804, cloud storage, portable memory connected to computing device 802, portable memory connected to server 804, etc.). In some examples, input data source 806 can include an application configured to generate input data and provide the input data via a software interface. In some examples, input data source 806 can be local to computing device 802. In some examples, input data source 806 can be remote from computing device 802, and can communicate input data 810 to computing device 802 (and/or server 804) via a communication network (e.g., communication network 808). In some examples, the input data source 806 may include multiple sources of input data, such sensors (as described above), a cooling system, a heating system, a warehouse management system, etc.

In some examples, the input data 810 may include sensor data and/or component data as defined above, as well the identity of servers (e.g., one or more of servers 804) to which data is and/or state information (e.g., on/off or intermediary power levels) for a light, a speaker, a heating system, a cooling system or other devices associated with system 100. Additional and/or alternative attributes of the input data 810 may be recognized by those of ordinary skill in the art at least in light of teachings provided herein.

In some examples, communication network 808 can be any suitable communication network or combination of communication networks. For example, communication network 808 can include a Wi-Fi network (which can include one or more wireless routers, one or more switches, etc.), a peer-to-peer network (e.g., a Bluetooth network), a cellular network (e.g., a 3G network, a 4G network, a 5G network, etc., complying with any suitable standard) which may include a narrowband Internet of things (NB-IoT) communications protocol, a wired network, etc. In some examples, communication network 808 can be a local area network (LAN), interfaces conforming known communications standard, such as Bluetooth® standard, IEEE 802 standards (e.g., IEEE 802.11), a ZigBee® or similar specification, such as those based on the IEEE 802.15.4 standard, a wide area network (WAN), a public network (e.g., the Internet), a private or semi-private network (e.g., a corporate or university intranet), any other suitable type of network, or any suitable combination of networks. In some examples, communication links (arrows) shown in FIG. 8 can each be any suitable communications link or combination of communication links, such as wired links, fiber optics links, Wi-Fi links, Bluetooth® links, cellular links, satellite links, etc. Communication network 808 may also utilize long range radio communications, referred to as "LoRa" and associated communication protocol and system architecture referred to as "LoRaWAN." Advantageously, LoRa can provide "Internet of things" type functionality but does not rely on a cellular networks, with a range on the order of tens of kilometers.

Figure 9:
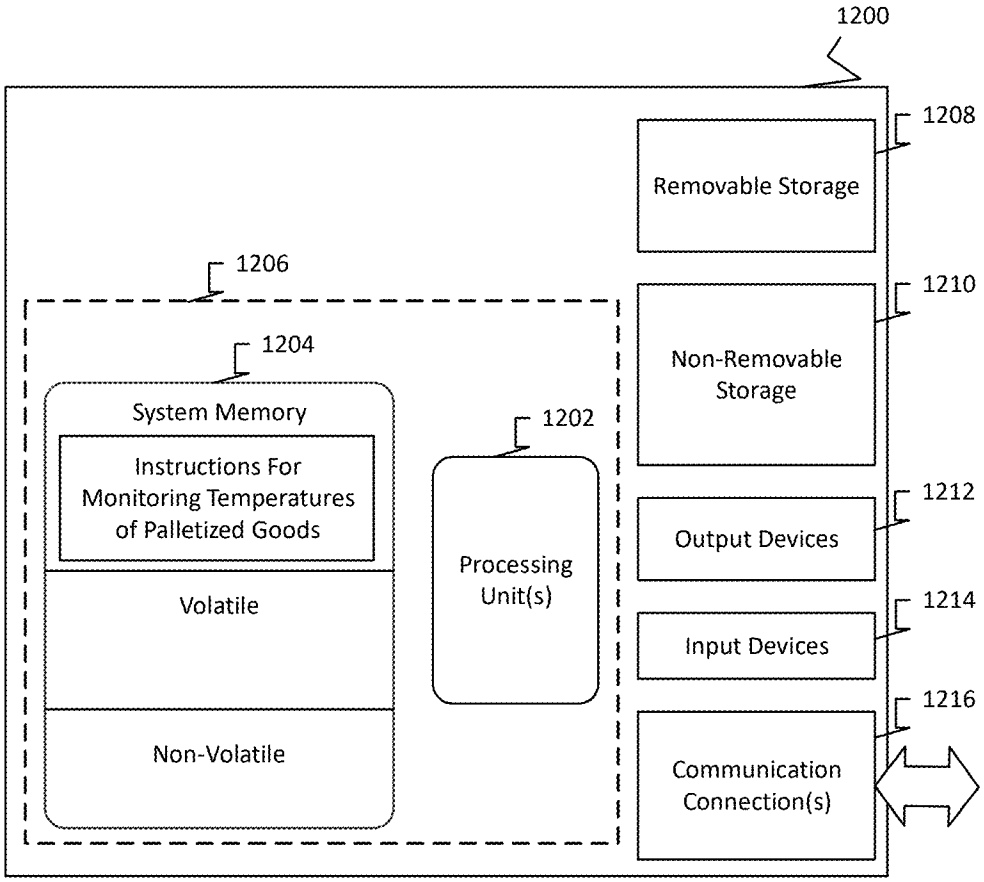
FIG. 9 is a schematic device made in accordance with the present disclosure.

FIG. 9 illustrates a simplified block diagram of a device with which aspects of the present disclosure may be practiced in accordance with aspects of the present disclosure. The device may be a mobile computing device, for example. One or more of the present embodiments may be implemented in an operating environment 1200. This is only one example of a suitable operating environment and is not intended to suggest any limitation as to the scope of use or functionality. Other well-known computing systems, environments, and/or configurations that may be suitable for use include, but are not limited to, personal computers, server computers, hand-held or laptop devices, multiprocessor systems, microprocessor-based systems, programmable consumer electronics such as smartphones, network PCs, minicomputers, mainframe computers, distributed computing environments that include any of the above systems or devices, and the like.

In its most basic configuration, the operating environment 1200 typically includes at least one processing unit 1202 and memory 1204. Depending on the exact configuration and type of computing device, memory 1204 (e.g., instructions for one or more aspects disclosed herein, such as one or more aspects of methods/processes discussed herein) may be volatile (such as RAM), non-volatile (such as ROM, flash memory, etc.), or some combination of the two. This most basic configuration is illustrated in FIG. 9 by dashed line 1206. Further, the operating environment 1200 may also include storage devices (removable, 1208, and/or non-removable, 1210) including, but not limited to, magnetic or optical disks or tape, flash drives, solid-state drives (SSD), and the like. Similarly, the operating environment 1200 may also have input device(s) 1214 such as remote controller, keyboard, mouse, pen, voice input, on-board sensors, etc. and/or output device(s) 1212 such as a display, speakers, printer, motors, etc. Also included in the environment may be one or more communication connections 1216, such as LAN, WAN, a near-field communications network, a cellular broadband network, point to point, etc.

Operating environment 1200 typically includes at least some form of computer readable media. Computer readable media can be any available media that can be accessed by the at least one processing unit 1202 or other devices comprising the operating environment. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, RAM, ROM, EEPROM, flash memory or other memory technology, CD-ROM, digital versatile disks (DVD) or other optical storage, magnetic cassettes, magnetic tape, magnetic disk storage or other magnetic storage devices, flash drives, solid-state drives (SSD), or any other tangible, non-transitory medium which can be used to store the desired information. Computer storage media does not include communication media. Computer storage media does not include a carrier wave or other propagated or modulated data signal.

Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

The operating environment 1200 may be a single computer operating in a networked environment using logical connections to one or more remote computers. The remote computer may be a personal computer, a server, a router, a network PC, a peer device or other common network node, and typically includes many or all of the elements described above as well as others not so mentioned. The logical connections may include any method supported by available communications media. Such networking environments are commonplace in offices, enterprise-wide computer networks, intranets and the Internet.

Figure 10:
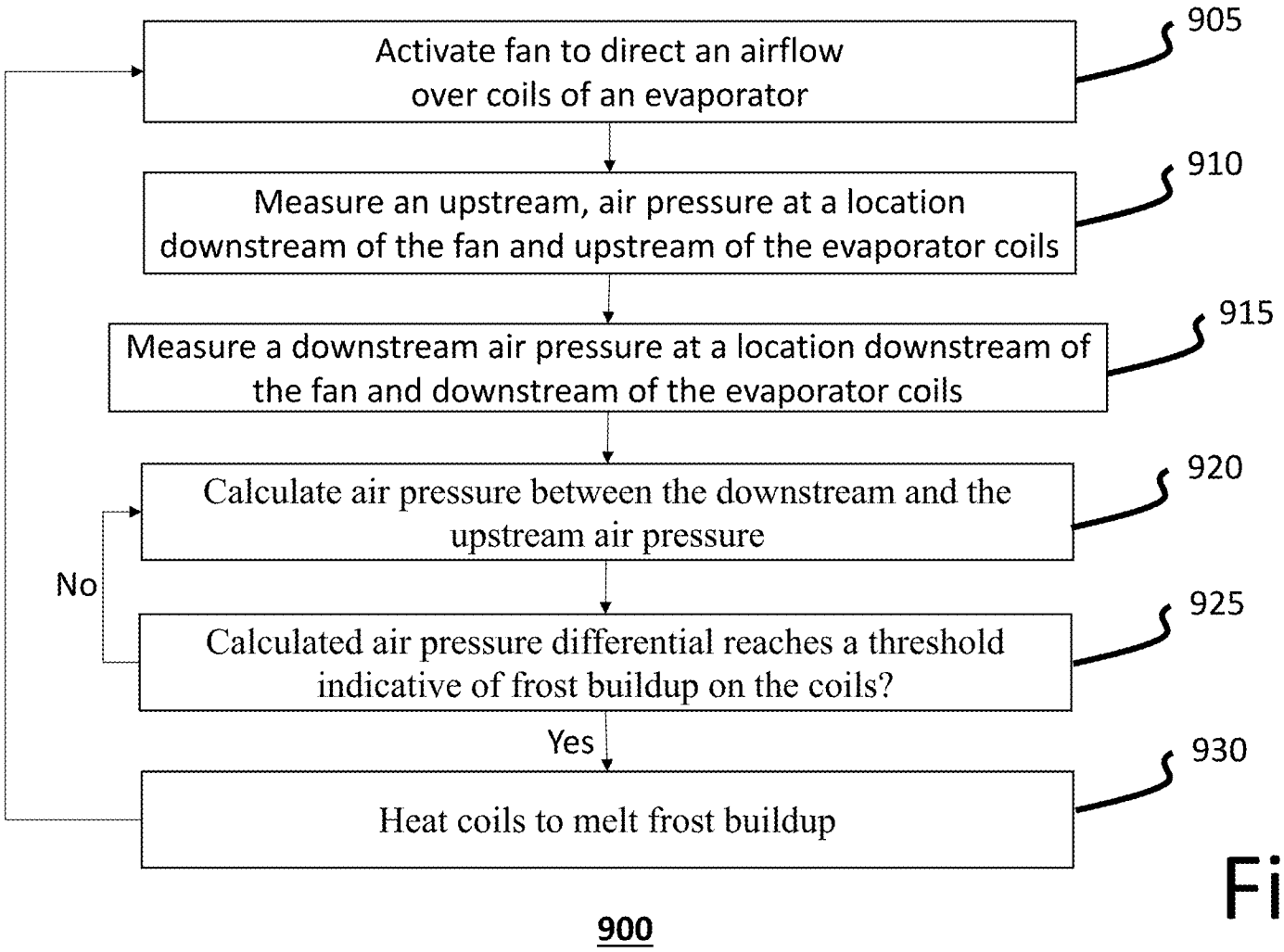
FIG. 10 is an example method of demand-defrost of evaporator coils, according to some aspects provided herein.

FIG. 10 illustrates an example method 900 of defrosting evaporator coils, according to some aspects described herein. In example, aspects of method 900 are performed by a device, such as computing device 802 and/or server 804, discussed above with respect to FIG. 8.

Figure 2:
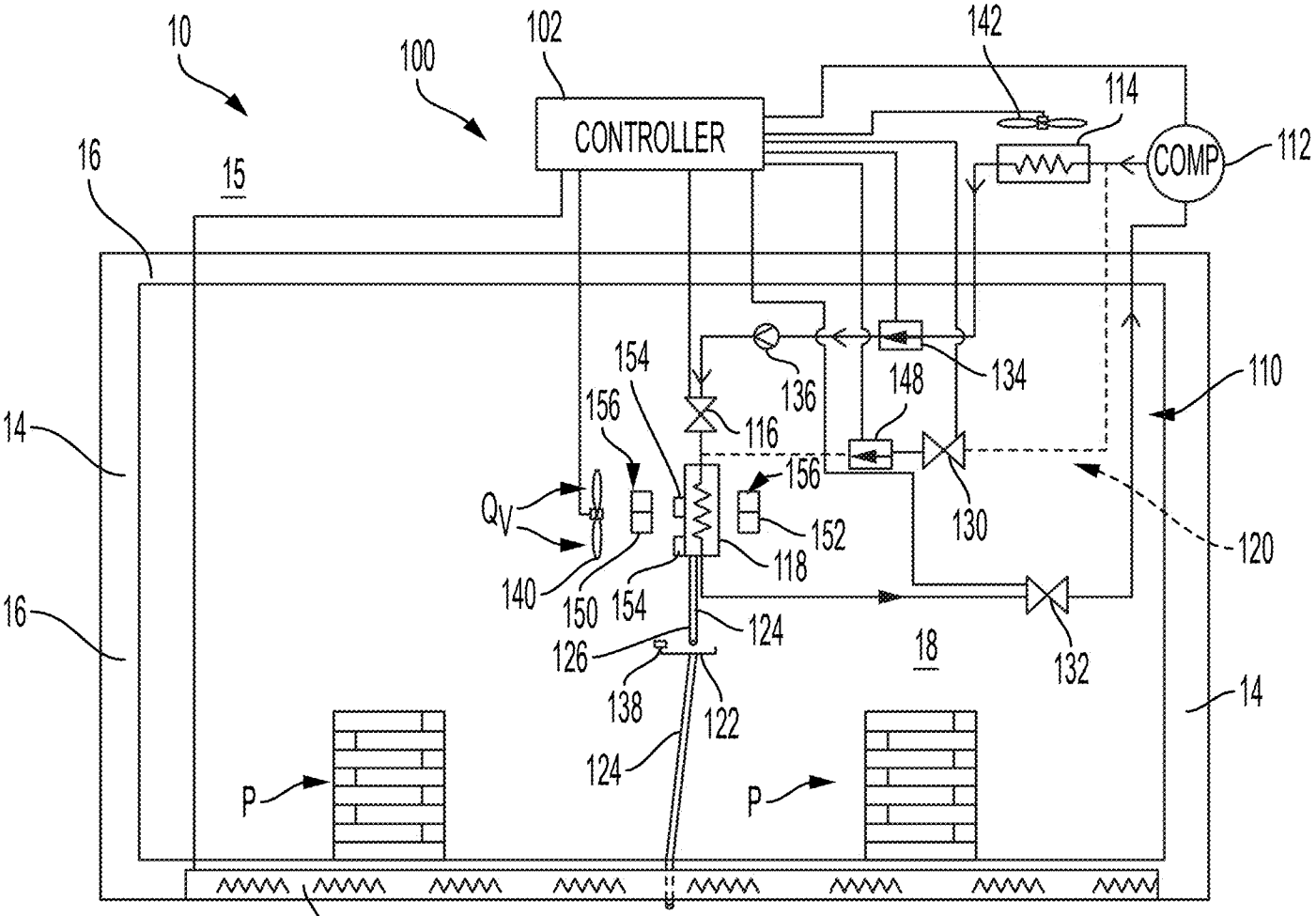
FIG. 2 is a schematic view of the warehouse shown in FIG. 1, illustrating a configuration of a vapor compressions system and controller in accordance with the present disclosure.

Method 900 begins at operation 905, wherein a fan, such as fan 140 shown in FIG. 2, and described above, is activated to direct an airflow over coils of an evaporator, such as evaporator 118. The activation signal may be issued by controller 102 via a network (e.g., network 808). As described herein, the controller 102 may communicate with the fan 140 and other associated sensors and components via an external/centralized system.

At operation 910, an upstream air pressure is measured at a location downstream of the fan and upstream of the evaporator coils.

At operation 915, a downstream air pressure is measured at a location downstream of the fan and downstream of the evaporator coils.

At operation 920, an air pressure differential is calculated between the downstream and the upstream air pressure.

At operation 925, a query is made whether the calculated air pressure differential reaches a threshold indicative of frost buildup on the coils. If the result of the query is "no," the method returns to operation 920. If the query is "yes," the coils are heated to melt the frost buildup at operation 930.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A defrost system comprising:

a vapor compression system including a compressor, a condenser, an expansion valve, an evaporator having coils and an airflow pathway therethrough, and a quantity of refrigerant;

a defrost heater operably connected to the evaporator and configured to melt accumulated ice or frost from the coils of the evaporator upon activation;

a fan positioned and oriented to blow over the coils of the evaporator;

a controller;

an upstream pressure sensor operably connected to the controller and positioned downstream of the fan and upstream of the airflow pathway through the evaporator;

a downstream pressure sensor operably connected to the controller and positioned downstream of the airflow pathway through the evaporator; and the controller programmed to:

process signals received from the upstream pressure sensor and the downstream pressure sensor to determine whether a defrost cycle is needed; and upon determination that the defrost cycle is needed, initiate the defrost cycle via control over at least one component of the vapor compression system.

2. The defrost system of claim 1, wherein:

the controller is programmed to:

compute an air pressure differential across the coils of the evaporator from the signals;

determine a frost-free air pressure differential as measured by the upstream and downstream pressure sensors when the coils of the evaporator are in a frost-free condition; and determine an operational air pressure differential as measured by upstream and downstream pressure sensors, at a time later than the determination of the frost-free air pressure differential;

wherein the controller is programmed to determine whether a defrost cycle is needed by comparing an increase in air pressure differential from the frost-free air pressure differential to the operational air pressure differential; and wherein the controller is programmed to initiate the defrost cycle when the increase in air pressure differential reaches a threshold level.

3. The defrost system of claim 2, wherein the controller is programmed to determine that the threshold level is reached when the operational air pressure differential is at least 100 hPa higher than the frost-free air pressure differential.

4. The defrost system of claim 2, wherein the controller is programmed to determine that the threshold level is reached when the operational air pressure differential is at least 125 hPa higher than the frost-free air pressure differential.

5. The defrost system of claim 2, wherein the controller is programmed to determine that the threshold level is reached when the operational air pressure differential is at least 150 hPa higher than the frost-free air pressure differential.

6. The defrost system of claim 2, wherein the controller is programmed to determine that the threshold level is reached when the operational air pressure differential is at least 175 hPa higher than the frost-free air pressure differential.

7. The defrost system of claim 2, wherein the controller is programmed to determine that the threshold level is reached when the operational air pressure differential is at least 200 hPa higher than the frost-free air pressure differential.

8. The defrost system of claim 1, further comprising:

a suction-stop valve positioned downstream of the evaporator and upstream of the compressor, the suction-stop valve operably connected to the controller and activatable to slow or stop a flow of fluid through the vapor compression system, wherein:

the controller initiates the defrost cycle comprises by activating the suction-stop valve to halt circulation of the refrigerant.

9. The defrost system of claim 8, further comprising:

a liquid solenoid positioned downstream of the condenser and upstream of the expansion valve.

10. The defrost system of claim 9, further comprising a hot-gas solenoid configured and positioned to admit a flow of hot gasses into the evaporator from the defrost heater during defrost cycles, wherein the controller is programmed to initiate a defrost cycle by:

performing a pump-out step comprising closing the liquid solenoid, opening the suction-stop valve, and activating the fan;

after the pump-out step, performing a hot-gas step comprising closing the suction-stop valve and deactivating the evaporator fan, and then opening the hot-gas solenoid to allow the hot gasses to flow to the evaporator;

after the hot-gas step, performing a bleed step comprising maintaining the configuration of the vapor compression system from the pump-out step until a pressure difference between an inlet of the compressor and a pressure in the evaporator is reduced to a predetermined threshold; and after the bleed step, performing a refreeze step comprising opening the suction-step valve and opening the liquid solenoid while keeping the fan deactivated, for a time sufficient to allow any residual moisture to refreeze on the coils of the evaporator.

11. The defrost system of claim 10, wherein the hot-gas solenoid is positioned to receive the hot gasses from the discharge of the condenser, whereby waste heat from the condenser is used for the defrost cycle.

12. The defrost system of claim 1, further comprising:

an upstream temperature sensor operably connected to the controller and located upstream of the airflow pathway through the evaporator; and a downstream temperature sensor operably connected to the controller and located downstream of the airflow pathway through the evaporator, the controller programmed to:

determine a frost-free temperature differential between the upstream temperature sensor and the downstream temperature sensor while the evaporator is in a frost-free condition;

determine an operational temperature differential between the upstream temperature sensor and the downstream temperature sensor at a time later than the determination of the frost-free temperature differential; and in response to the operational temperature differential reaching a programmed threshold level below the frost-free temperature differential, confirm initiation of the defrost cycle.

13. The defrost system of claim 1, further comprising:

an upstream combined remote sensor including the upstream pressure sensor and the upstream temperature sensor sharing a single upstream housing; and a downstream combined remote sensor including the downstream pressure sensor and the downstream temperature sensor sharing a single downstream housing.

14. A method of defrosting evaporator coils, the method comprising:

activating a fan to direct an airflow over the evaporator coils;

measuring an upstream air pressure at a location downstream of the fan and upstream of the evaporator coils;

measuring a downstream air pressure at a location downstream of the fan and downstream of the evaporator coils;

calculating an air pressure differential between the downstream and the upstream air pressure; and when the calculated air pressure differential reaches a threshold indicative of frost buildup on the coils, heating the coils to melt the frost buildup.

15. The method of claim 14, wherein:

the step of calculating comprises:

calculating a frost-free air pressure differential when the coils of the evaporator are in a frost-free condition; and calculating an operational air pressure differential, at a time later than the step of calculating the frost-free air pressure differential; and the threshold is measured as a threshold increase in the operational air pressure differential as compared to the frost-free air pressure differential.

16. The method of claim 14, wherein the step of heating the coils comprises directing a hot gas into the coils.

17. The method of claim 16, wherein the step of directing the hot gas into the coils comprises directing gasses from the discharge of the condenser, such that waste heat from the condenser is used to defrost the coils.

18. The method of claim 14, further comprising, before the step of heating, deactivating a compressor in fluid communication with the evaporator as part of a vapor compression system.

19. The method of claim 18, further comprising, after the step of heating and upon a determination that the coils are frost-free, ceasing the heating and reactivating the compressor.

* * * * *